United States Patent [19]

Chietti

[11] 4,267,708

[45] May 19, 1981

[54] CIRCULAR HOSIERY MACHINE AND THE LIKE, HAVING SIMPLIFIED PROGRAM CONTROL MEANS

[75] Inventor: Giovanni Chietti, San Casciano Val di Pesa, Italy

[73] Assignee: Macchine Tessili Circolari MATEC S.p.A., Italy

[21] Appl. No.: 969,292

[22] Filed: Dec. 14, 1978

[30] Foreign Application Priority Data

Dec. 16, 1977 [IT] Italy ..... 9659 A/77

[51] Int. Cl.[3] ..... D04B 15/94; D04B 15/00

[52] U.S. Cl. ..... 66/56; 66/237; 66/239

[58] Field of Search ..... 66/56, 224, 231, 234, 66/237, 240

[56] References Cited

U.S. PATENT DOCUMENTS

| | | | |
|---|---|---|---|
| 1,127,768 | 2/1915 | Houseman et al. | 66/56 X |
| 2,323,998 | 7/1943 | Hutton, Jr. et al. | 66/231 X |
| 2,722,116 | 11/1955 | Griesbach | 66/56 |
| 3,774,417 | 11/1973 | Bini | 66/234 |
| 4,151,729 | 5/1979 | Micheletti | 66/231 X |

FOREIGN PATENT DOCUMENTS

| | | | |
|---|---|---|---|
| 2739051 | 3/1978 | Fed. Rep. of Germany | 66/154 R |
| 936344 | 9/1963 | United Kingdom | 66/50 B |
| 1040021 | 8/1966 | United Kingdom | 66/56 |

*Primary Examiner*—Wm. Carter Reynolds
*Attorney, Agent, or Firm*—McGlew and Tuttle

[57] ABSTRACT

A circular knitting machine for knitting hosiery has a program drum which can be advanced through short or longer-pitch movements in dependence on an arrangement of removable pins located in seats around the drum. The presence, absence, and length of the pins is sensed mechanically by a control device associated with an incremental advance mechanism for the drum. The speed of the needle cylinder is also controlled in dependence on the arrangement of pins. By changing the arrangement, articles of different size can be produced on the machine.

4 Claims, 16 Drawing Figures

Fig.1
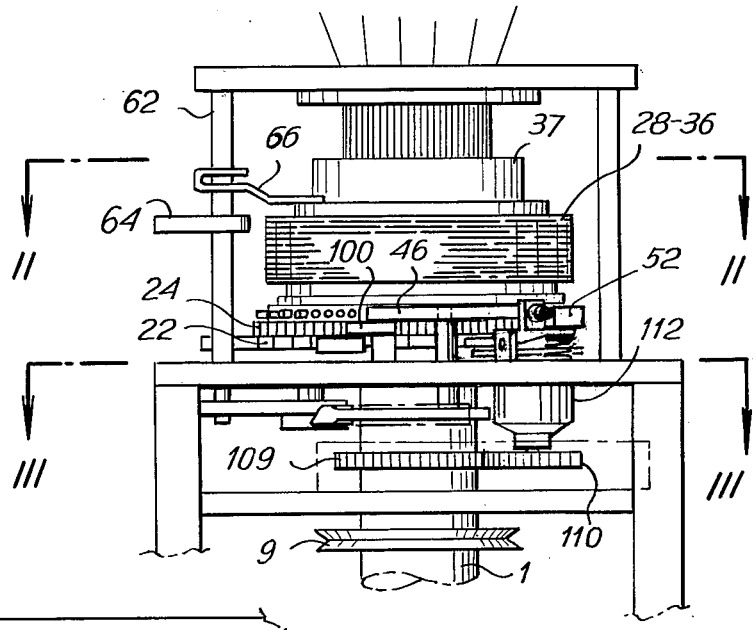
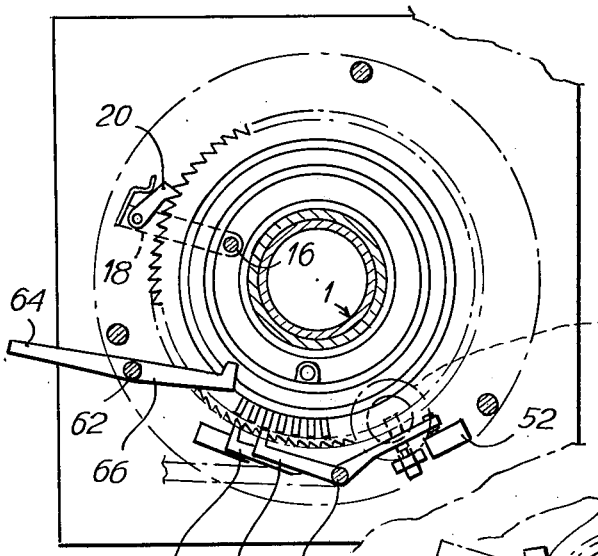
Fig.2
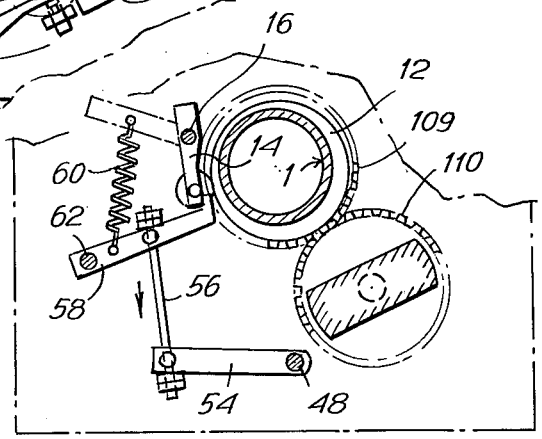
Fig.3

Fig.9
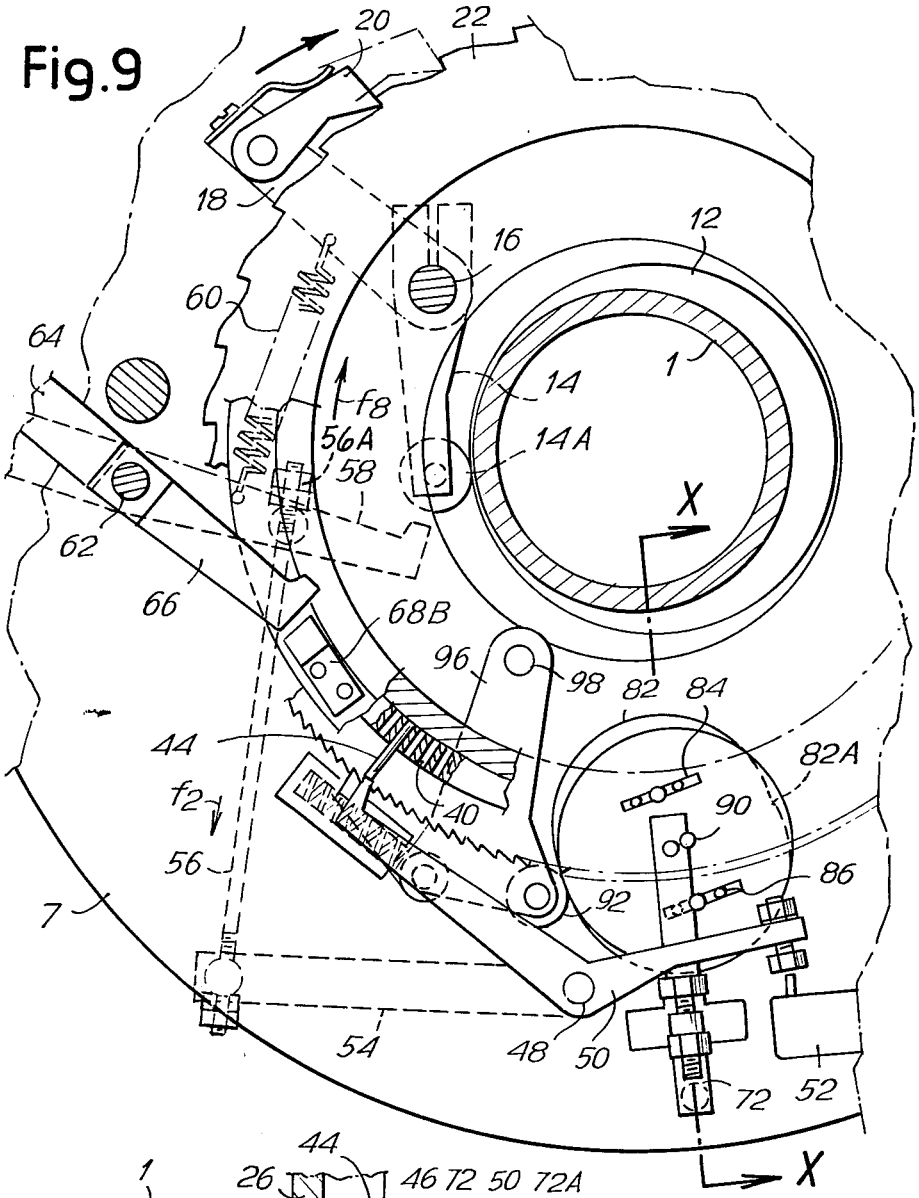
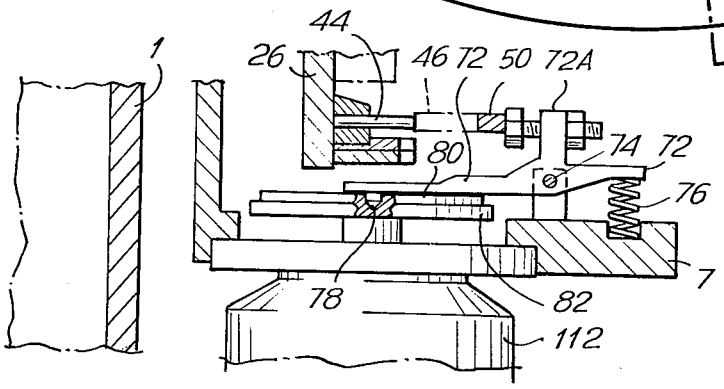
Fig.10

CIRCULAR HOSIERY MACHINE AND THE LIKE, HAVING SIMPLIFIED PROGRAM CONTROL MEANS

FIELD OF THE INVENTION

The present invention relates to circular knitting machines.

SUMMARY OF THE INVENTION

According to the present invention, there is provided in a circular knitting machine, a needle cylinder, means defining a control cam shell, means defining a program cam drum, said cam shell and program drum being co-axial with the needle cylinder, pawl means for advancing said drum and means for causing the drum to advance selectively through angular movements of short or long-pitch, said advancing means comprising means defining an array of seats on the drum, removable pin means located in selected ones of the seats, and control means cooperating with the pin means and operative to control the pawl means in dependence on the arrangement of the pin means so as to effect short or long-pitch advance of the drum.

BRIEF DESCRIPTION OF THE DRAWINGS

An embodiment of the invention will now be described, by way of example only, with reference to the accompanying drawings, in which:

FIG. 1 is a fragmentary side elevation of a circular knitting machine in accordance with the present invention;

FIGS. 2 and 3 are sections respectively taken on lines II—II and III—III of FIG. 1;

FIG. 9 shows a detail of FIG. 4 at a time when the control arrangement is set to provide long-stroke angular advancements of the program drum;

FIG. 10 is a sectional view taken on line X—X of FIG. 9;

DESCRIPTION OF THE PREFERRED EMBODIMENTS

Figure 4:
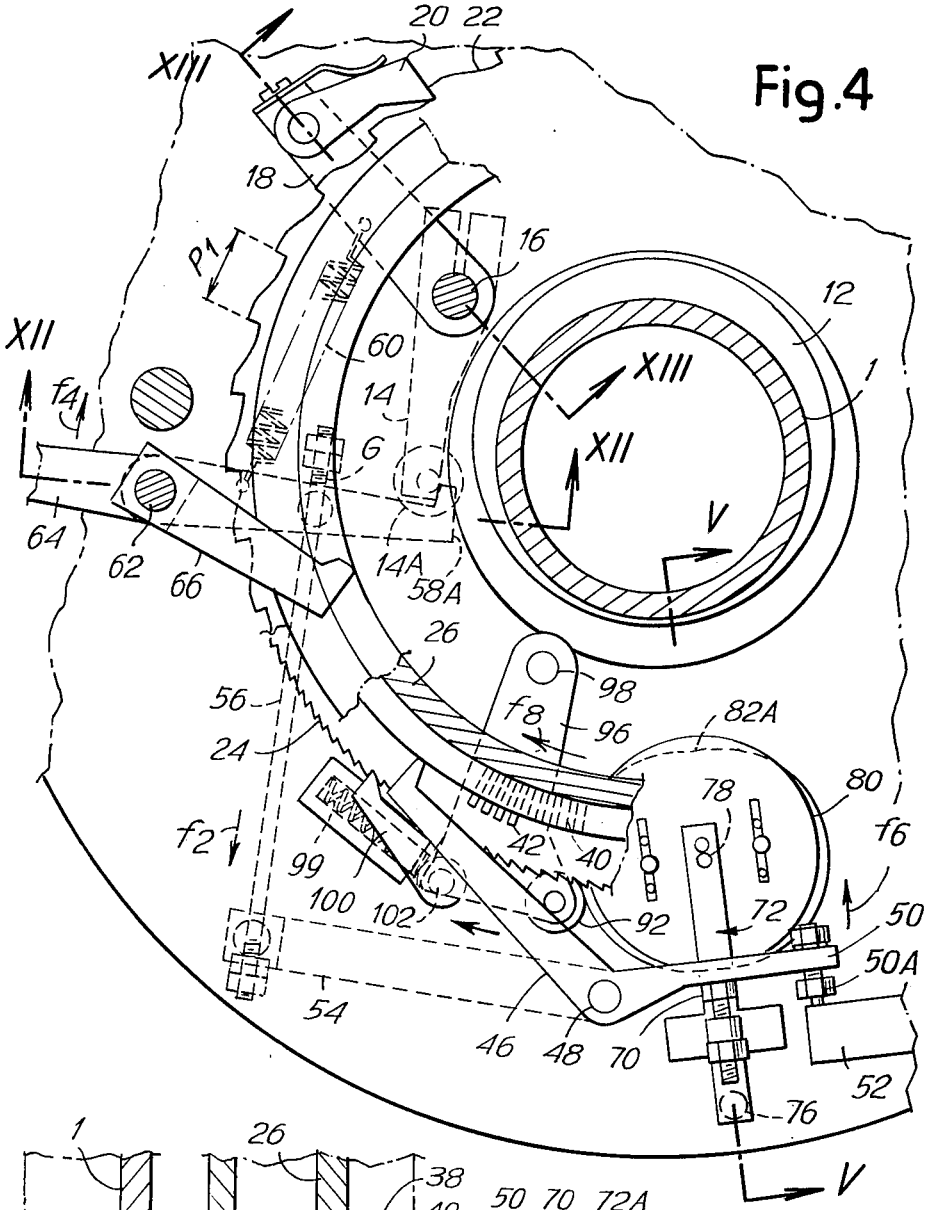
FIG. 4 shows, on an enlarged scale, a detail of FIG. 2 at a time when the control arrangement is set to provide double-frequency small-stroke angular advancements of a program drum of the machine.
Figure 5:
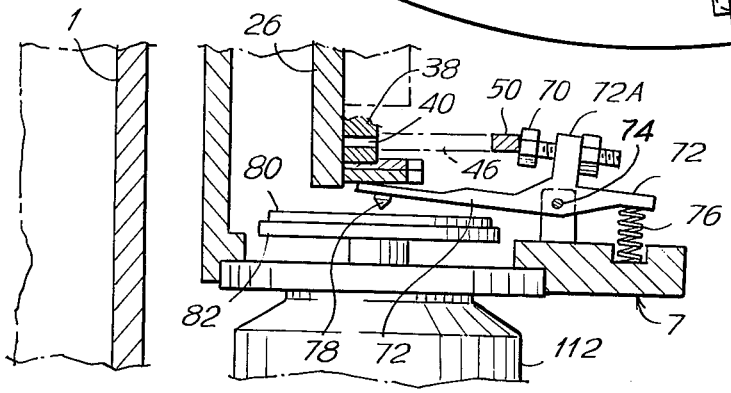
FIG. 5 is a sectional view taken on line V—V of FIG. 4.
Figure 12:
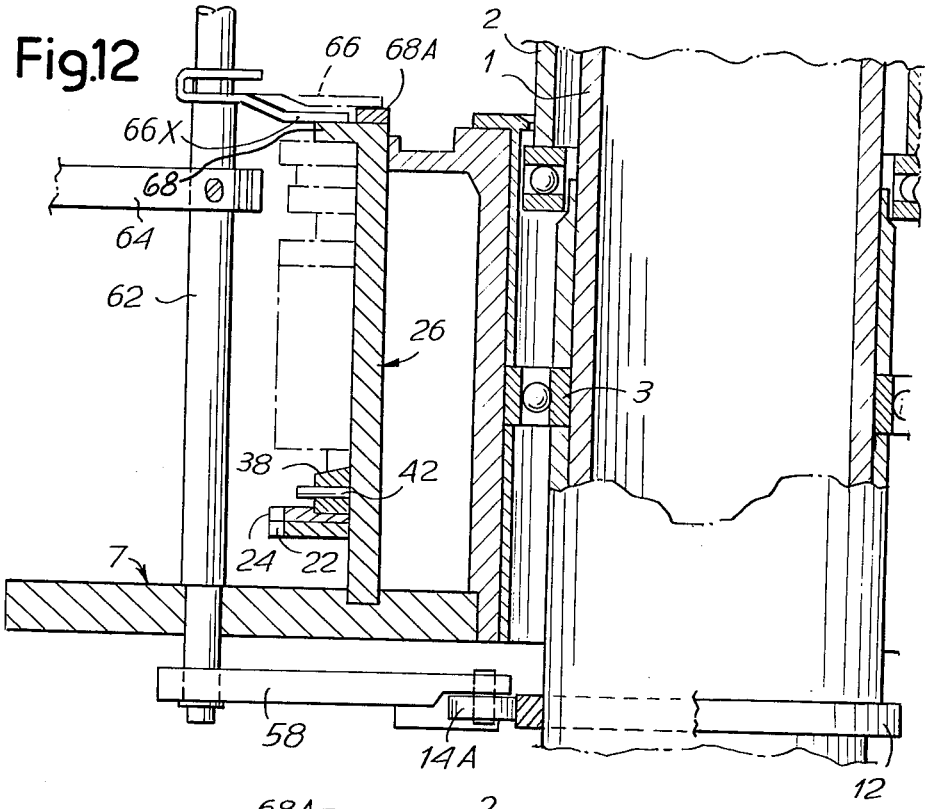
FIGS. 12 and 13 are sectional views respctively taken on lines XII—XII and XIII—XIII of FIG. 4.
Figure 13:
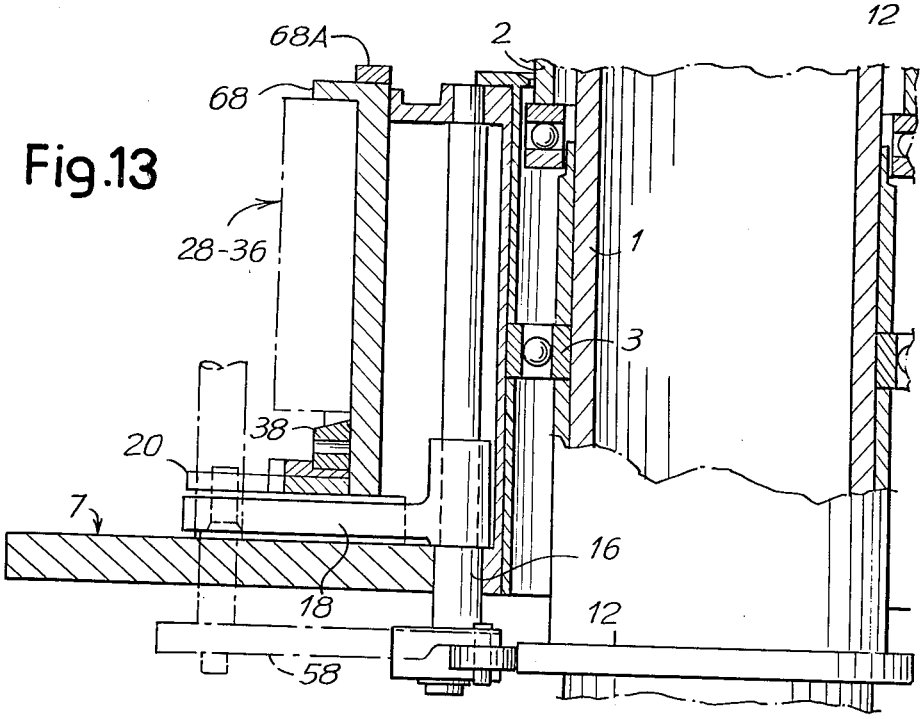

The circular knitting machine shown in the drawings comprises a cylindrical tubular element 1 which is combined with a needle cylinder 2 and which is mounted by means of rolling bearings 3 and 5 in a fixed structure 7 (see FIGS. 1, 12 and 13). A belt pulley 9 is connected for rotation to the element 1 and is rotated by a motor and belt or the like to drive the needle cylinder 2 via the element 1. An eccentric cam 12, which is also connected for rotation to the element 1, co-operates with a roller 14A of an arm 14 which is rigidly connected to a shaft 16 (see FIG. 3). The shaft 16 is, in turn, rigidly connected to an arm 18 carrying an oscillating pawl 20 (see FIGS. 2 and 4), this arm being resiliently biased against a toothed rim 22 having inclined ratchet-like teeth of a relatively large pitch or extent $P_1$. The toothed rim 22 may be produced by a mechanical working process or by the application of bars of the like.

Figure 6:
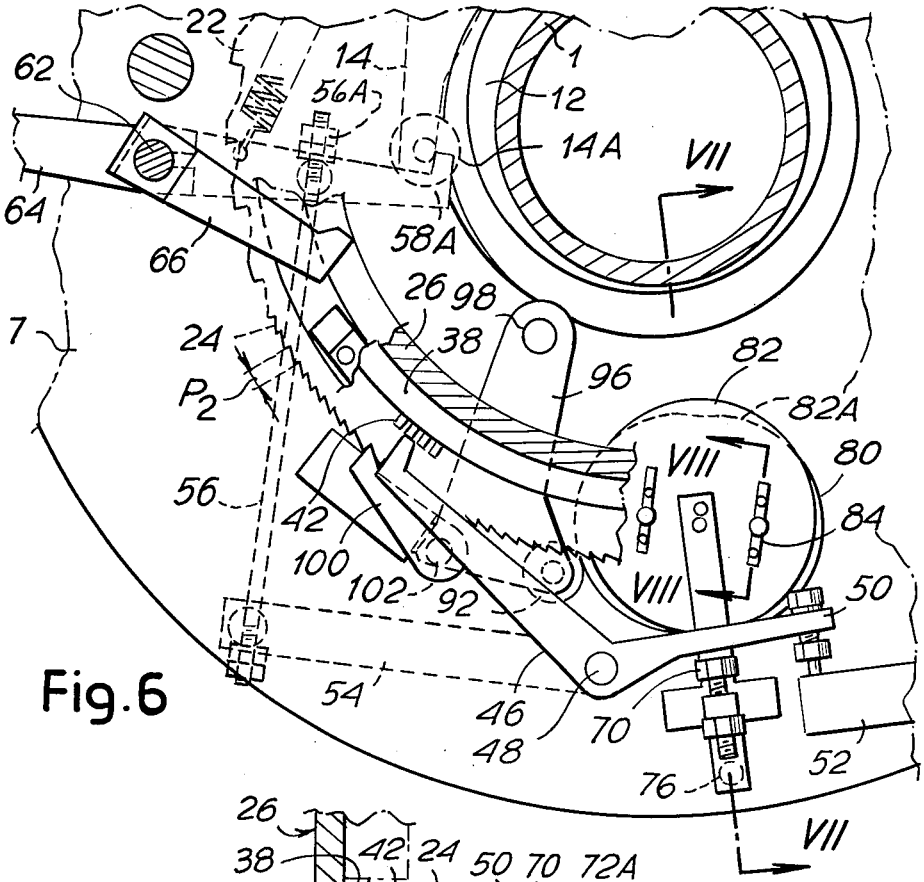
FIG. 6 shows a detail of FIG. 4 with the control arrangement set to provide single-frequency short-stroke angular advancements of the program drum.
Figure 7:
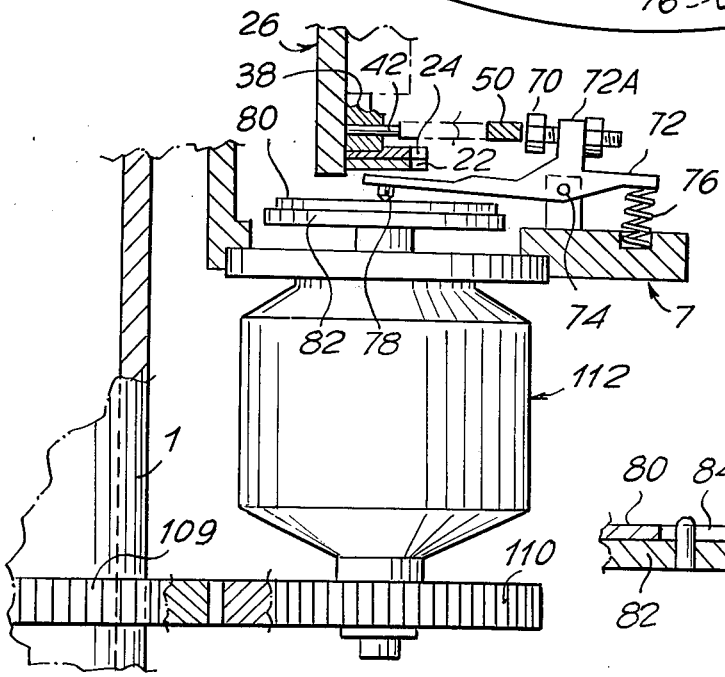
FIG. 7 is a sectional view taken on line VII—VII of FIG. 6.

The toothed rim 22 is adjacent a second toothed rim 24 having inclined ratchet-like teeth of a pitch $P_2$ which is much smaller than $P_1$ (see FIGS. 1 and 6). The two toothed rims 22 and 24 are mounted on the lower end of a program drum 26 carrying cams 28—36, the drum 26 being co-axial with the element 1 and extending around and beneath the lower end of the needle cylinder 2 and below a shell 37 carrying cams for the needles and jacks of the machine. Above the toothed rim 24 is a ring 38 having a series of radially-extending seats 40 (see FIGS. 9, 12, 13). In these seats 40 are located pins 42 and pins 44 of a greater length than the pins 42. An oscillating lever 46 mounted on a shaft 48, cooperates with the outer surface of the ring 38 and pins 42 and 44. The shaft 48 carries an arm 50, rigidly connected to the lever 46 and preferably coplanar with the lever 46 (see FIGS. 4 and 6). The free end of the lever 50 carries an actuator 50A associated with a micro-switch 52 of the needle cylinder speed control. Micro-switch 52 is of known design and, for example, controls a motor which drives the belt pulley 9. Micro-switch 52 drives this motor at high speed when lever 50 is fully engaged with the micro-switch 52 and, at low speed when the lever 50 is fully disengaged from the micro-switch 52 in accordance with the invention.

Figure 8:
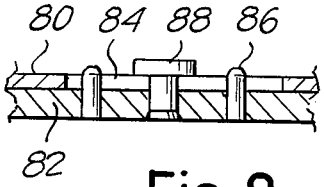
FIG. 8 is a sectional view on line VIII—VIII of FIG. 6.
Figure 11:
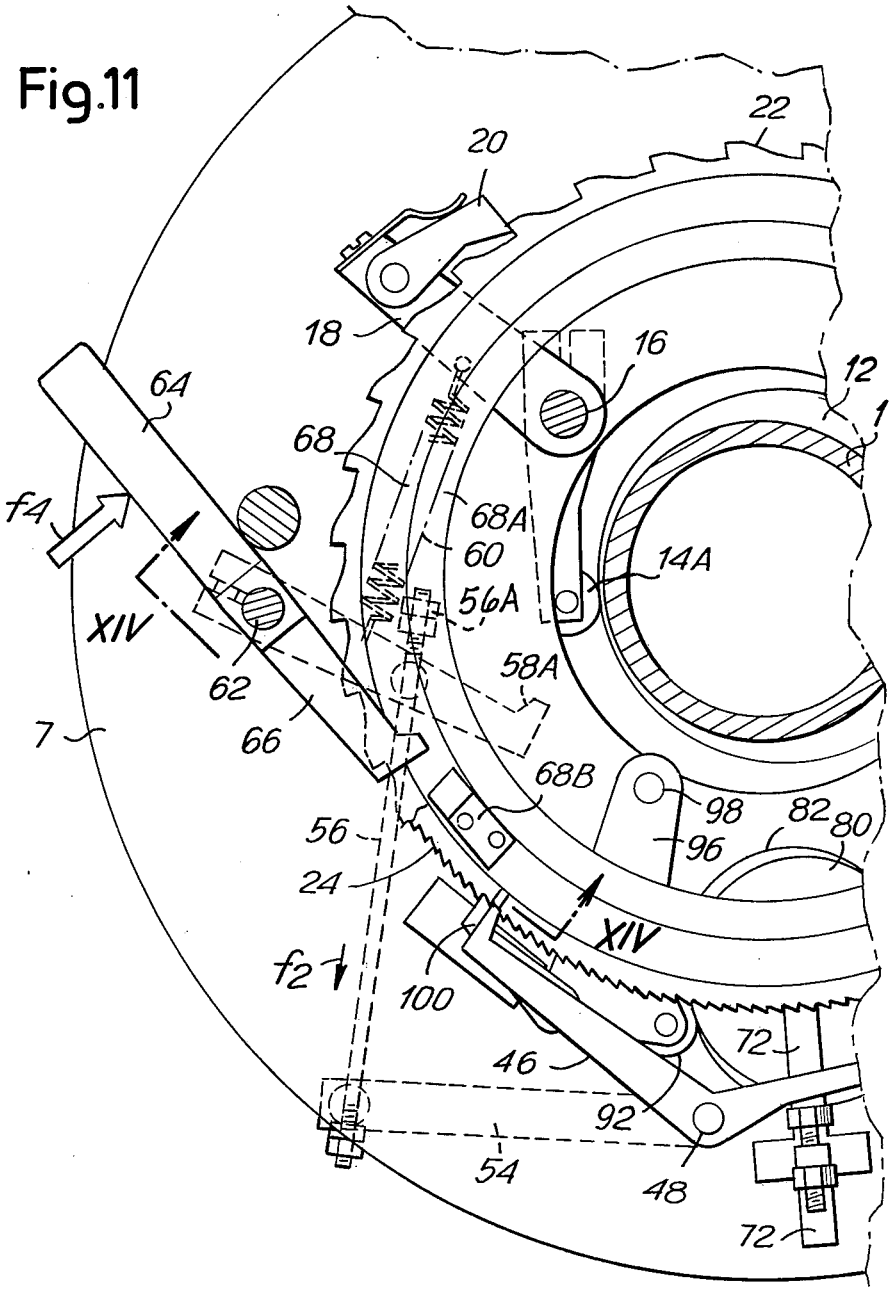
FIG. 11 shows a detail of FIG. 4 in a zero-setting control starting array.
Figure 14:
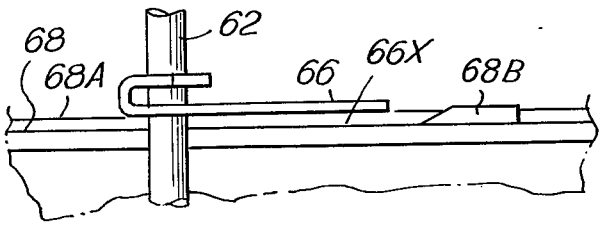
FIG. 14 is a fragmentary sectional view taken on line XIV—XIV of FIG. 11.

An arm 54 which is rigidly connected to the shaft 48 and thus also with the arms 46 and 50, acts upon a tie rod 56 (see FIGS. 3 to 10) passing through oscillating bushings of the arm 54 and an arm 58, so as to leave an operating clearance G between the tie rod 56 and arm 58. The clearance G is represented in the drawings in different positions between an edge of the arm 58 and the head 56A of the rod 56. A tooth 58A at one end of arm 58 is capable of keeping arm 14 spaced from cam 12, under the action of a spring 60 which reacts directly between arm 18 and arm 58. Movement of the tie rod 56 in the direction of arrow $f_2$ (see FIGS. 4, 9, 11) causes the release of the tooth 58A from the arm 14 and thereby the release of this arm. The arm 58 is mounted on a pin 62, to which an arm 64 for a manual zero-setting control, and a resiliently-biased pawl 66 are also fastened. This pawl, under normal conditions, engages a raised side 68A of a track 68, so that the tooth 58A maintains the arm 14 spaced from the cam 12. When the manual control lever 64 is moved in the direction of arrow $f_4$ (FIG. 11), the arm 58 is moved to such an extent as to cause, in addition to the release of the arm 14, also the release of pawl 66 from the side 68A of the track 68. This causes rapid movement of the rim 22 and also of the drum 26 until a zero-setting position is reached. The zero-setting position is defined by a radial cam projection 68B of track 68 disposed radially outwardly of the side 68A, having an inclined plane profile for effecting movement of the pawl 66 from the position in which it engages the track 68 at a position radially outwardly of side 68A, to the position in which the pawl 66, under the action of the spring 60, is released to again engage the side 68A of the track 68. This causes the arm 14 to be again retained by means of tooth 58A in the condition of maximum displacement effected by cam 12 thereby to render the pawl 20 inoperative. The rapid movement of rim 22 is achieved by the fact that arm 14, being released, permits the engagement of roller 14A on cam 12. Cam 12, being carried on tubular element 1 and rotated at relatively high speeds, oscillates the arm 14 back and forth which causes the pawl 20 to move rim 22 forwardly on each rotation of tubular element 1 by the distance $P_1$. This rotation is in a direction $f_8$. Once cam projection 68B comes into contact with the forward edge of pawl 66 which is on the right, as seen in FIG. 14, the inclined surface of cam projection 68B rides under this edge of pawl 66 causing it to bend upwardly slightly and also to move radially inwardly. As seen in FIG. 11, the flat surface of the forward edge of pawl 66 is shaped so as to interact with the inclined surface of projection 68B and cause it move radially inwardly of the element 1. The arm 50, which is controlled via the lever 46 by means of the pins 44 and 42 and the track formed by the outer surface of the ring 38, cooperates with an adjustable head 70 carried by an extension 72A of a rocking lever 72 pivotally connected at 74 to the fixed structure 7 (see FIGS. 4 to 10). The lever 72 is biased by a spring 76 in a direction to press a pin 78 carried at its end, onto a disc 80. The disc 80 is slidably mounted over a cam 82 provided with two hollows 82A and the disc serves to selectively vary the effective active profile of the cam 82. The disc 80 is slidably engaged for movement in the direction of the two hollows 82A by means of, for example, slots 84 on the disc, pairs of guide pins 86 on the cam 82 and engaged in the slots 84 and at least one button shaped head 88 for retaining the disc 80 in contact with the cam 82 (see FIG. 8). The disc 80 also has two holes 90 which are closely adjacent in a position in the central portion of the disc. These holes are aligned in the direction of sliding of the disc 80 (as defined by the slots 84) and either one of the two holes 90 may cooperate with pin 78 when the lever 72 is free from restraint by the lever 50, and is biased by spring 76 so that the pin 78 moves into one of the holes 90 in the surface of disc 80 when one of the two holes is located under the pin.

A roller 92 cooperates with the cam 82 and with the disc 80. The roller 92 is carried by an arm 96 pivotally mounted at 98 on the fixed structure and biased by a relatively strong spring 99 to press against the cam 82 (see FIG. 4). This action causes the disc 80 to slide back and forth in the direction of its slots so as to uncover cyclically each of the two hollows 82A each time one of them passes the roller 92 during each rotation of the cam 82, when the lever 72 is kept away from the disc 80 by the arm 50 acting on the head 70, when the lever 46 bears directly on the ring 38 in the absence of pins 42 or 44. When the lever 46 is moved by means of a pin 42 or 44, the arm 50 is moved in the direction of arrow $f_6$ and allows spring 76 to push on arm 72 so that this arm engages the disc 80. Under these conditions the pin 78 is positioned to move into either one of the two holes 90 as soon as one of them moves into alignment with the pin 78, which occurs within a maximum of half a revolution of the cam 82. As a result, with the lowering of arm 72 under the action of the lever 46 cooperating with a pin 42 or 44, the disc 80 is locked in one of the two positions in which it is pushed laterally by the roller 92 when the latter is in correspondence with one of the two hollows 82A. As a consequence the disc 80 extends over the other of said hollows 82A and neutralizes the action of this other hollow 82A on the roller 92.

When the disc 80 is released, at each revolution of the cam 82, the arm 96 completes two oscillations caused by the active presence of the two hollows 82A. When disc 80 is locked, at each revolution of the cam 82, the arm 96 completes only one oscillation. The two different oscillatory frequencies of arm 96 (one being double the other) are transmitted to a pawl 100 pivotally mounted at 102 on arm 96. This pawl acts on the toothed rim 24 in such a way as to cause the advancement of the cam drum 26 by the pitch $P_2$ at each oscillation. The cam 82 and the disc 80 are rotated by the element 1 via gears 109 and 110 and a speed reducer unit 112 interposed between the gear 110 and the cam 82. The speed reduction from the element 1 to the cam 82 may be 8:1, for example.

As long as the lever 46 engages the outer surface of the ring 38 in areas having neither pins 42 or 44, the arm 50 acts on the micro-switch 52 to maintain a high speed of the element 1 and thus of the needle cylinders, and the arm 50 acts also upon the head 70 of the lever 72 to maintain the pin 78 raised from the disc 80. Thus the disc 80 is free and is pushed cyclically in opposite directions by the roller 92. At every revolution of the cam 82 a double action, that is a double oscillation of the pawl 100 upon the toothed rim 24 is obtained. Thus an advancement of the cam shell occurs in the direction of the arrow $f_8$. When the lever 46 engages a short pin 42, the lever 46 displaces the arm 50 so as to allow the lowering of the arm 72 when one of the holes 90 is moved by the pushing action of the rollers 92 into alignment with the pin 78 which is coincident with the rotational axis of the cam 82. Thereby the disc 80 is locked in the position in which it neutralizes the hollow 82A positioned after that which has caused the rollers 92 to push the disc 80. The effective active profile of the cam 82 is thereby varied. From this time, the cam 82 acts with only a single hollow 82A active on the roller 92 and therefore the pawl 100 acts only once at each revolution of the cam 82. With an 8:1 drive ratio there will be eight revolutions of the element 1 between one operation of the pawl 100 and the next under the conditions discussed above. While under the preceding conditions with the disc 80 released, one operation of the pawl 100 will occur every four revolutions of the element 1.

This change in the operating frequency of the pawl 100 on the toothed rim 24, depending upon the presence or the absence of the pins 42 on the ring 38 in a predetermined arc of the cam drum 26 enables the length of the article knitted on the machine to be changed over this arc of the cam drum. By modifying the arrangement of pins 42, the "size" of the article, relative to the length which is knitted in the above mentioned arc of the cam drum, is changed.

This working arc is defined between one or more pins 44 of greater length. During all of those phases, the micro-switch 52 is maintained under a condition in which it effects high speed drive of the needle cylinder.

When the lever 46 is engaged by a pin 44 and is further moved, the displacement of the arms 50, 54 is greater. This allows the head 50A to move away from the micro-switch 52 by such a distance as to permit the micro-switch to reduce the rotational speed of the needle cylinder. Also the longer displacement of the arm 54 causes release of the arm 14. It is to be noted that while the lever 46 was bearing on the ring 38 or a pin 42, the motion of the tie rod 56 in the direction of the arrow $f_2$ did not change the position of the arm 58, because the movement of the lever 46 caused by the change from absence to presence of a pin 42 simply caused the clearance G to be taken-up. Under these conditions, the arm 58 and the arm 14 remain stationary with the roller 14A being spaced from the cam 12 and therefore the pawl 20 remains inactive during continuous rotation of cam 12 at the frequency of rotation of the needle cylinder.

When the lever 46 is engaged by a pin 44, the greater stroke which this pin 44 imposes to tie rod 56 in the direction of the arrow $f_2$ causes the release of the arm 14 whereby its roller 14A engages the cam 12 and the pawl 20 is oscillated at a frequency dependent on the speed of the cam 12. This pawl 20 causes at each oscillation, advancement of the toothed rim 22 by a pitch $P_1$ and also of the program drum 26 which controls the working elements associated with the needle cylinder rotates at a lower speed as a result of the operation of the micro-switch 52. This action continues while the pins 44 are in contact with the lever 46. It is noted that, while the pawl 20 is operative to move the program drum 26, pawl 100 engaging the teeth of rim 24 is ineffective since the teeth of rim 24 having the much smaller pitch $P_2$ moves ineffectively beneath the pawl 100 causing it to move out of the way with each forward incremental movement of the program drum by the distance $P_1$ which is caused by the pawl 20. For clarity, it is also noted at this point that a single forward and functioning rotation of the program drum 26 occurs to produce a single product such as a stocking. In the absence of a pin 44 in correspondence with the lever 46, the previous conditions of advancement over the smaller pitch $P_2$, either once or twice at every revolution of cam 82 are resumed. At the first movement of the arm 14 by the cam 12 following the noticed absence of a pin 44 in contact with the arm 46, the arm 58 (which is again activated by sliding of tie rod 56 in the direction opposite to that of the arrow $f_2$) hooks the arm 14 again and disengages the pawl 20.

Upon manual control of the lever 64, a displacement of the arm 58 greater than that obtained through the return of the tie rod 56, is caused, whereby the pawl 66 engages the track 68. Thereby long and rapid oscillations of the pawl 20 occur until the zero-setting position, defined by the cam projection 68B, is reached. The machine can then begin to knit a new article.

Figure 15:
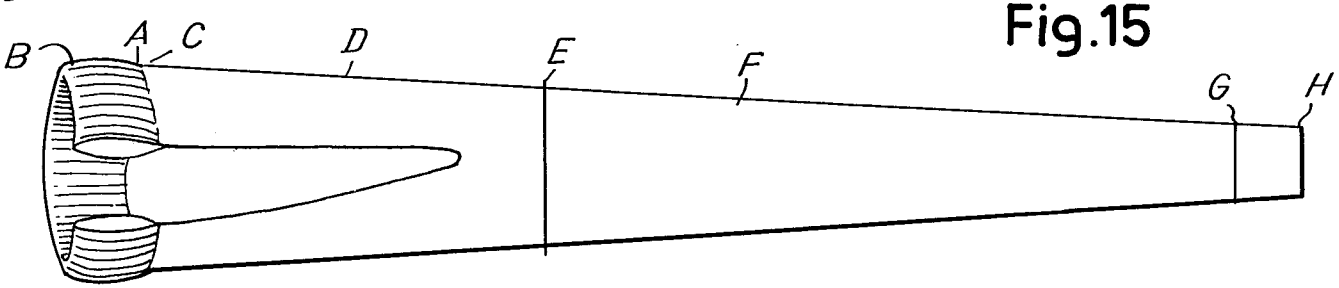
FIG. 15 is a schematic view of an article knitted on the machine.

FIG. 15 shows a typical article which may be knitted on the machine, the article shown being a pair of tights. At the zone marked A in FIG. 15 the welt is started and may include elastic yarns. Zone B is a so-called turned welt. Zone C is the connection zone between B and A. Zone D is a zone of uniform knitting which is cut to make the body portion of the tights. The zone E is a connecting zone between the body portion and the leg portion where at least one yarn substitution occurs. Zone F corresponds to the leg portion and foot portion, these articles generally having no heel portion. Zone G is a yarn exchange zone, and zone H is a uniform zone comprising fabric which is to be sewn together to form a toe closure. Zones B, D, F, H or at least zones D and F may be knitted at high speed, since the fabric in these zones is uniform. In the zones A, C, E, and G, knitting is effected at a reduced speed.

Zones D and F, at least, may be modified in length to obtain required size variation.

Figure 16:
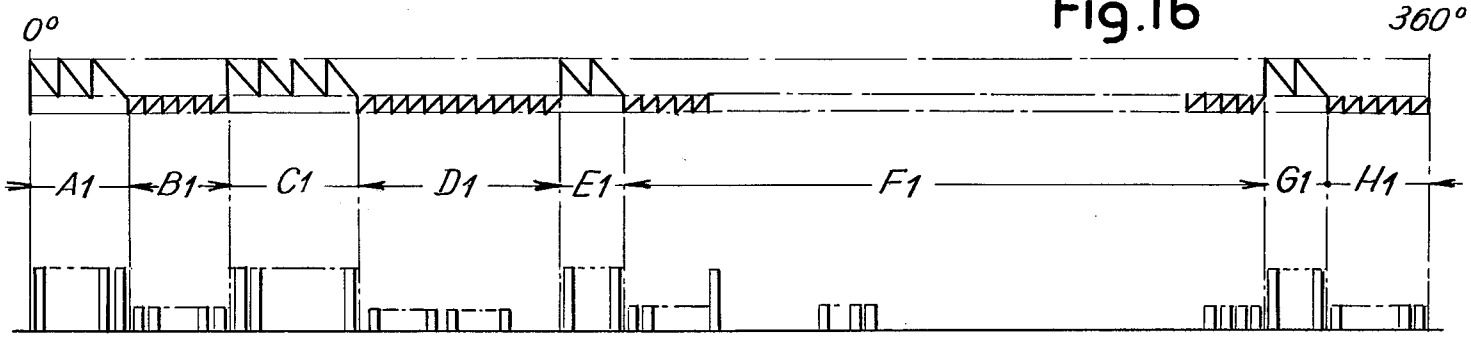
FIG. 16 is a developed view showing one possible control program.

FIG. 16 shows a development of the control program provided by the pins 42 and 44 to obtain the various parts of the article of FIG. 15. In the area denoted by A1 three long-pitch movements occur and therefore in this area there will be long pins. In the area $B_1$ there are short pins or no pins at all.

In area $C_1$ long pins are provided in order to obtain long-pitch movements so as to carry out the welt discharge program. In area $D_1$ short pins 42 are provided in a varying number, to obtain different lengths of the zone D of the article.

In area $E_1$ long pins are provided, for example, to effect two long-pitch movements. In area $F_1$ a varying number of pins 42 is provided to obtain the different lengths of the zone F of the article. It must be noted that a size change may be obtained also through the presence of some long pins 44, by means of which the length of the zone being knitted may be considerably shortened, since the presence of a long pin 44 causes a long-pitch movement which shortens the manufactured article by an extent corresponding, for example, to that of six small-pitch movements.

In area $G_1$ long pins are provided, for example to effect two long-pitch movements, and in area $H_1$ there are pins 42 or no pins, to obtain a generally constant length of fabric. The number of long-pitch movements in the areas $A_1$, $C_1$, $G_1$ will depend upon the required controls which will be carried out following the program to produce each of the corresponding zones A, C and G of the manufactured article.

The machine particularly described permits easy and fine changes in the dimensions of the knitted article and ensures the accurate timing of the program phases. The whole structure is carried by a single member which also comprises the speed controls. In addition a rapid zero-setting operation is provided.

What is claimed is:

1. A circular knitting machine comprising a needle cylinder, means defining a control cam shell, means defining a program cam drum, said cam shell and program drum being co-axial with the needle cylinder, pawl means for advancing said drum, means for causing the drum to advance selectively through angular movements of short or long-pitch, said advancing means comprising means defining an array of seats on the drum, removable pin means located in selected ones of the seats, and control means cooperating with the pin means and operative to control the pawl means in dependence on the arrangment of the pin means so as to effect short or long-pitch advance of the drum, two ratchet wheels rotatable with the drum, one of said ratchet wheels having small-pitch teeth, and the other of said ratchet wheels having long-pitch teeth, said pawl means comprising first and second pawls each associated with a respective one of the two ratchet wheels, said control means being operative to actuate a selected one of the two pawls in accordance with the arrangement of the pin means, a manual control for actuating that one of the pawls which is associated with the ratchet wheel having long-pitch teeth to cause a rapid advancement of the drum to a zero-setting position, means for maintaining said advancement until said zerosetting position has been reached, a cam rotatable with the needle cylinder, means linking the cam to that one of the pawls which is associated with the ratchet wheel having long-pitch teeth such that the pawl is reciprocated by rotation of the cam, said linking means being rendered selectively operative and inoperative by the action of said control means and of said manual control, and means for changing the speed of needle cylinder rotation, such that during the long-pitch advancements of the drum, the cylinder rotates at a reduced speed.

2. A machine according to claim 1, wherein the pin means comprise pins of two different lengths, said speed-changing means being controlled by the length of the pin means such that the cylinder is operative at one speed in correspondence of the shorter length pins, and at a second different speed, in correspondence of the longer length pins.

3. A machine according to claim 2, further comprising a cam for controlling operation of that one of the pawls which is associated with the ratchet wheel having small-pitch teeth, the cam having a variable active profile, and the arrangement of said pins serving to cause a change in the active profile of said cam.

4. A machine according to claim 2, wherein said control means includes a cam having at least two hollows mounted for rotation with a rotation of said needle cylinder, a disc slidably mounted to said cam for selectively overlaying one of said hollows, a roller arm pivotable against said cam and with the passage of said hollows and said disc when said disc is moved to cover one of said hollows, said roller arm connected to said first pawl associated with said small-toothed ratchet wheel for advancement of the drum, and disc holding means engageable with said disc to hold said disc in its position covering at least one of said hollows when said speed-varying means is controlled by said longer length pins.

* * * * *